US009940911B2

(12) United States Patent
Molnar

(10) Patent No.: US 9,940,911 B2
(45) Date of Patent: Apr. 10, 2018

(54) SOUND POST, SOUND POST TOOL SET AND METHOD FOR ASSEMBLING THE SOUND POST INTO A STRINGED INSTRUMENT

(71) Applicant: Pal Molnar, Rastatt (DE)

(72) Inventor: Pal Molnar, Rastatt (DE)

( * ) Notice: Subject to any disclaimer, the term of this patent is extended or adjusted under 35 U.S.C. 154(b) by 0 days.

(21) Appl. No.: 15/322,290

(22) PCT Filed: Jun. 24, 2015

(86) PCT No.: PCT/IB2015/054731

§ 371 (c)(1),
(2) Date: Dec. 27, 2016

(87) PCT Pub. No.: WO2015/198237

PCT Pub. Date: Dec. 30, 2015

(65) Prior Publication Data

US 2018/0040310 A1 Feb. 8, 2018

(30) Foreign Application Priority Data

Jun. 27, 2014 (DE) ..... 10 2014 009 336

(51) Int. Cl.

| | |
|---|---|
| ***G10D 3/02*** | (2006.01) |
| ***G10D 1/02*** | (2006.01) |
| *G10D 1/00* | (2006.01) |

(52) U.S. Cl.
CPC ..... *G10D 3/02* (2013.01); *G10D 1/02* (2013.01); *G10D 1/005* (2013.01)

(58) Field of Classification Search
CPC ..... G10D 1/02
See application file for complete search history.

(56) References Cited

U.S. PATENT DOCUMENTS

| | | | |
|---|---|---|---|
| 1,466,681 | A | 9/1923 | Todd |
| 2,145,237 | A | 1/1939 | Eberhart |
| 2,162,595 | A | 6/1939 | Virzi |
| 4,955,274 | A | 9/1990 | Stephens |
| 5,208,408 | A | 5/1993 | Cave |

FOREIGN PATENT DOCUMENTS

| | | | |
|---|---|---|---|
| DE | 3914591 | A1 | 11/1990 |
| DE | 4437676 | A1 | 5/1996 |

*Primary Examiner* — Kimberly Lockett
(74) *Attorney, Agent, or Firm* — Laurence A. Greenberg; Werner H. Stemer; Ralph E. Locher

(57) ABSTRACT

A sound post, in particular for stringed instruments, and a sound post assembly set. The sound post is composed of at least two sound post components and has end pieces which can be pivoted at the end faces of the sound post. The second sound post component has a threaded portion, and the first sound post component has an inner thread which corresponds to the threaded portion such that the sound post components can be screwed together and thus adjusted vertically or longitudinally relative to each other. The threaded portion has a fine thread. Furthermore, a scale with an equidistant graduation is arranged on one of the at least two sound post components. The graduation of the scale corresponds to the pitch of the fine thread.

13 Claims, 5 Drawing Sheets

SOUND POST, SOUND POST TOOL SET AND METHOD FOR ASSEMBLING THE SOUND POST INTO A STRINGED INSTRUMENT

BACKGROUND OF THE INVENTION

Field of the Invention

The invention relates to a sound post and a sound post tool set and a method for assembling the sound post, in particular, into a stringed instrument.

It is known from the prior art that in some musical instruments, in particular in stringed instruments, a sound post is fitted between the top and back, primarily in a region below the right-hand foot of a bridge. Generally this is a small cylindrical piece of wood. This sound post affects the sound properties of the instrument as well as the stability thereof, since it prevents deformation or even destruction of the top of the violin. It is a drawback here that when fitting the sound post the length of the small piece of wood has to be accurately determined and both ends of the small piece of wood have to be adapted to the curvature of an inner face of the top and back. If the sound post has an incorrect length and/or height or the curvature changes due to atmospheric conditions, this may have a negative effect on the sound of the instrument.

DE 44 37 67 6 discloses a bridge and sound post system for improving the sound of stringed instruments, wherein the bridge and sound post are mounted on cone bearings so that the ends of the sound post are able to bear flush against an inner face of the top or back. This system requires a time-consuming adaptation of the sound post length for an accurate fitting of the sound post.

U.S. Pat. No. 5,208,408 A1 discloses a sound post which is able to be adjusted in height and which is constructed from a plurality of parts. A first component and a second component are provided, wherein the first component has a bore. The second component has a post which coincides in terms of width and length with the dimensions of the bore of the first component. In this case, the individual parts may be fitted together such that, by means of interposed disks of different sizes, a height of the sound post may be adjusted within a range of a few millimeters. In this case, it is awkward to adjust the height since to this end the sound post has to be repeatedly fitted and dismantled.

SUMMARY OF THE INVENTION

Proceeding from this prior art, it is the object of the present invention to provide a sound post, in particular for a stringed instrument, which is able to be fitted in a simple manner and which improves the sound properties of the stringed instrument.

This object is achieved by a sound post having the features as claimed.

A further object of the present invention is to simplify the assembly of such a sound post. This object is achieved by a sound post tool set for fitting a sound post between the top and back of the stringed instrument having the features as claimed.

The further object, to permit an accurate and accessible assembly of a sound post, is achieved by the method for assembling the sound post, in particular into a stringed instrument, having the features as claimed.

Developments and/or preferred embodiments of the sound post, the sound post tool set and the method are disclosed in the subclaims.

One embodiment refers to a sound post, in particular for stringed instruments, which is composed of two or more sound post components and has end pieces which are able to be pivoted at the front faces thereof. In this case, the second sound post component also has a threaded portion and the first sound post component has an inner thread which corresponds to the threaded portion, such that the sound post components are able to be screwed together and thus are able to be adjusted relative to one another in height. According to the invention, the threaded portion has a fine thread. Moreover, a scale with an equidistant graduation is arranged on one of the two or more sound post components, wherein the graduation of the scale corresponds to the pitch of the fine thread.

The sound post may also be used in any type of stringed instrument, even in historical instruments or in plucked instruments and/or in other musical instruments with a sound post and may be advantageously inserted retrospectively. As it is able to be accurately adjusted in height, this sound post may, in particular, be retrofitted. Additionally, the sound post is able to harmonize the vibrations of the top and back of the instrument due to the accurate height adjustment and, as a result, considerably improve the sound properties and the internal stability thereof. The dimensions of the sound post may be adapted in an appropriate manner for violins, violas, violincellos or double basses.

By means of the fine thread which is provided according to the invention, a greater friction and finer graduation is produced than in normal threads, since a smaller pitch may be used. As a result, no further and/or separate fastening is required. For a sound post for a violin a pitch may be provided in a range of 0.5 mm to 1 mm, preferably 0.8 mm, and for a cello a pitch may be provided in a range of 1 mm to 1.5 mm, preferably 1.25 mm.

The scale may be printed in high-contrast onto film and also may be dimensioned such that it is congruent with an open part of the threaded portion. The threaded portion is thus able to be reliably protected from soiling.

In one development, the invention provides that the sound post components may consist of fiber-reinforced plastics, preferably of carbon (carbon fiber-reinforced plastics). This material has the advantage that a fine thread with a small pitch may be cut. The previous prior art could not provide such fine scale graduation, since an accurate fine thread could not be cut in the previously used materials, such as for example wood. The surface of the treated carbon has a specific degree of roughness which prevents an adjusted sound post from being able to move by the instrument being played, since the thread has a high frictional force under the pressure of the strings. Also, materials having a plastic matrix made of thermosetting resin, such as epoxy resin or thermoplastic materials, with variable fiber components may be used.

Moreover, it may be provided that the sound post is substantially cylindrical. It may comprise two or more fastening portions which have a polygonal cross section and are preferably octagonal. Such a cross section may be easily encompassed by a tool and the sound post may still be retrospectively adjusted in its length, even through the narrow f-holes of a violin. However, other hexagonal or ten sided cross sections, for example, may be implemented.

In one development of the invention, it may be provided that each end piece has a semi-spherical portion and a planar terminal surface. In this case, one respective semi-spherical recess may be provided on the front faces of the sound post, the semi-spherical portion being received therein. As a result, the end piece may be tiltably mounted in the recess.

The planar terminal surface may bear flush against the tilted wall of the top or back in a planar manner, whereby in particular an indentation is not produced on the inner face of the spruce wood top or the top is not able to be damaged.

The invention may further provide that the semi-spherical recess for fastening the end piece has a crimped portion on the edge. Alternatively, the recess and the respective end piece may have magnetic fastening means which are poled relative to one another such that the end piece may be retained magnetically inside the recess. These fastening means serve to secure the movable end pieces in a captive manner during the assembly and initial positioning.

By the sound post according to the invention being able to be adjusted easily in length and/or height and a good vibration coupling being able to be produced between the top and back of the stringed instrument, an improved sound of the instrument is advantageously produced relative to previous sound posts.

In order to fit the sound post accurately, a sound post tool set according to the invention is provided for assembling the above-described sound post between the top and back of the stringed instrument. This set comprises, in addition to the sound post, one or more adjustment tool(s) which in each case comprise a fork portion, a shank and a retaining portion, in particular in the form of a loop. In this case, the shank for reaching the respective fastening portions of the sound post is curved and has a length which equates at least to a length of a corresponding distance from a predetermined first stringed instrument f-hole to a predetermined position on the back of a stringed instrument. Thus the sound post may be easily reached and adjusted at the predetermined position below a right-hand foot of a bridge. A predetermined position within the meaning of the invention is a region in the interior of the instrument which is located below the right-hand foot of the bridge, i.e. generally below the highest string of the instrument, for example in violins the E-string, approximately 5 mm lower than the position of the bridge. A traditionally used sound post setter may also be used as an alternative adjustment tool to that set forth here, wherein a gripping region of the sound post setter corresponds to the gripping region of the adjustment tools.

Moreover, the set may comprise an insertion tool which is suitable for fitting, for inserting the sound post into the stringed instrument, wherein the insertion tool comprises an angled-back shank and a gripper portion. The insertion tool may have an actuating device in the form of a spring-loaded plunger. For small sound posts in smaller instruments, the gripper portion may be present as a single gripper with two gripper jaws. If larger sound posts are intended to be used, for example for a cello or double bass, the gripper portion of the insertion tool may be a double gripper and thus comprise a total of four gripper jaws. Thus the sound post may be securely retained and inserted carefully into the instrument through the first f-hole.

By means of the tool set according to the invention, in addition to being fitted during the construction of the stringed instrument the sound post may also be easily inserted retrospectively after the fitting of the bridge and strings. The aforementioned adjustment tools reach the positions to be reached inside the stringed instrument in an appropriate manner due to their curved shape. Thus for adjusting the length, amongst other things due to oblique and/or curved portions of the top and the back, the sound post does not always have to be dismantled again but is able to remain in situ. An instrument maker is thus able to be spared additional time-consuming operations.

In a preferred development of the invention, the shank of the adjustment tools and the angled-back shank of the insertion tool may be encased with a plastics material. Preferably it may be a plastics material which is also used for heat-shrinkable sleeves. Thus the delicate side edges of the f-holes and the wooden, lacquered top of the stringed instrument may be protected. Advantageously, a color differentiation of the plastics casing may be provided, depending on the type of instrument. Thus, for example, the insertion tool may be generally black and the adjustment tools for violins red and for violas yellow. The colors may, however, be freely selected.

Also, the first adjustment tool may have a longer shank than the second adjustment tool. Advantageously, the sound post may be optimally positioned since it is generally placed below the highest string of the stringed instrument and thus is closer to one f-hole than to the other f-hole. Alternatively the shanks of the tools may also be of the same length, wherein they may have a different bending radius. The sound post may thus be fitted in a simple and accurate manner.

A method according to the invention for assembling the above-described sound post into a stringed instrument may take place by means of the above-described sound post tool set. In a first step, the sound post is prepared and pre-adjusted to a predetermined height which is predetermined by the distance between the top and back of the stringed instrument. To this end, the height between the top and back may be measured by means of a sound post gauge. If an old wooden sound post is to be replaced, initially the strings may be detensioned and the wooden sound post dismantled. In this case, the length of the sound post according to the invention could be adjusted according to the length of the wooden sound post.

Subsequently, by means of the insertion tool the sound post is inserted through the first f-hole of the stringed instrument and the sound post is positioned at a predetermined position inside the stringed instrument. Due to its pre-adjusted length the sound post is in this case easily wedged between the top and back. The first adjustment tool or alternatively a sound post setter may be used as an aid. The scale in this case is visible through the first f-hole or even the second f-hole, wherein the sound post should be inserted such that the graduation mark may be easily seen through the first f-hole. Subsequently the tools may be removed from the instrument, the strings tensioned and/or tuned to the pitch and acoustically tested.

Subsequently, for adjusting the length of the sound post, the fork portion of the first adjustment tool is inserted into the second f-hole and the first fastening portion and thus the first sound post component are secured by means of the first adjustment tool on the first fastening portion. In addition, the fork portion of the second adjustment tool is inserted into the first f-hole and encompasses the second fastening portion by means of the second adjustment tool. At the same time, a rotation of the second sound post component takes place in a stepwise manner according to the scale, whereby the planar terminal surface of the end pieces is pressed onto or released from the back and top of the stringed instrument. Pressing or releasing in this case means that by lengthening and/or correspondingly shortening the sound post the tension which the sound post applies to the top and back is increased or reduced. The rotation takes place until an optimal sound is produced, which is why after each rotation the instrument is able to be played again.

This also permits a retrospective fitting, in addition to the fitting during the manufacture of the instrument—the bridge and strings no longer have to be dismantled but are able to remain in situ. Moreover, in contrast, the method may also be used for dismantling the sound post; in this case the sequence of the method is reversed.

Further embodiments and some of the advantages which are associated therewith and with further embodiments will become clearer and more easily comprehensible by means of the following detailed description, with reference to the accompanying drawings. Parts or components thereof which are substantially the same or similar may be provided with the same reference numerals. The drawings are only a schematic view of one embodiment of the invention.

DESCRIPTION OF THE INVENTION

The device according to the invention relates to a sound post 1 for stringed instruments.

Figure 1:
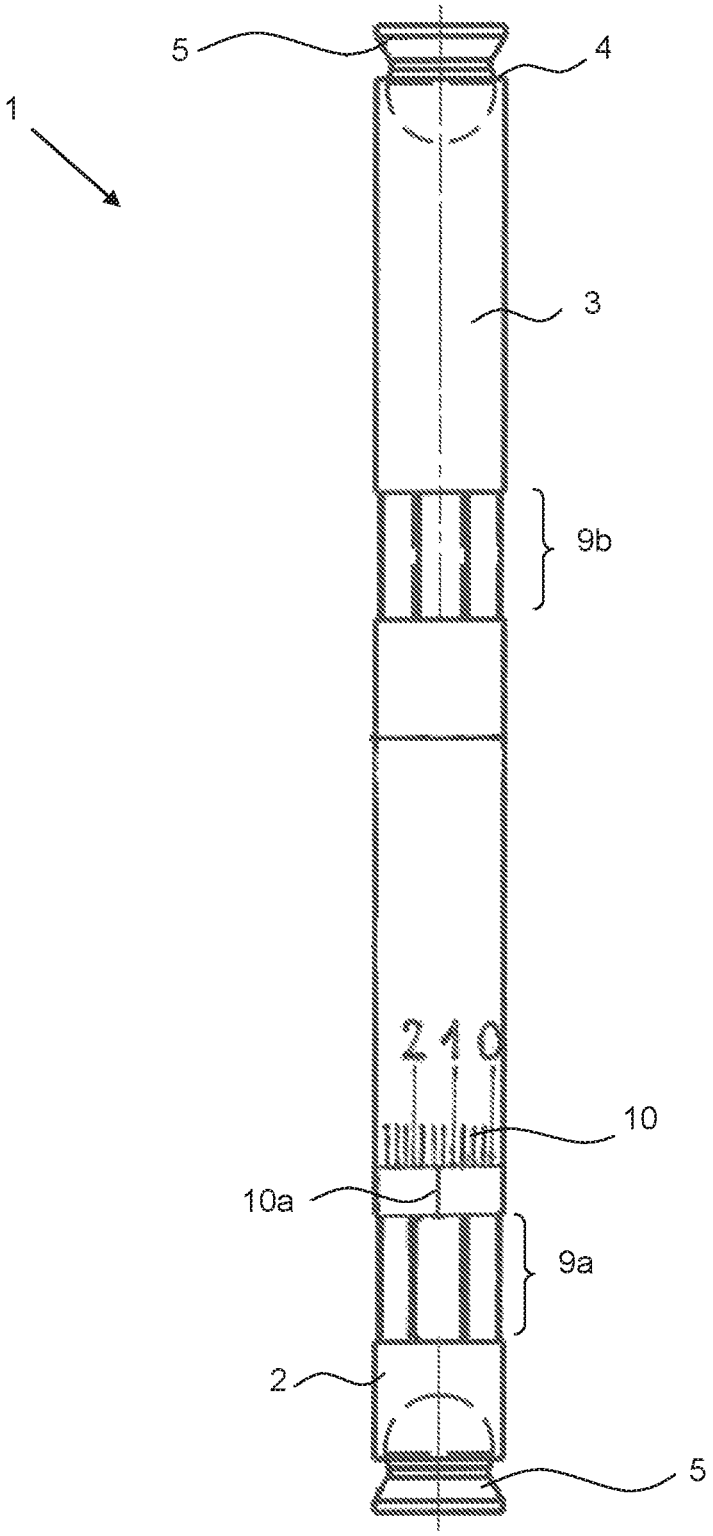
FIG. 1 shows a partial longitudinal section of the sound post according to the invention.
Figure 2:
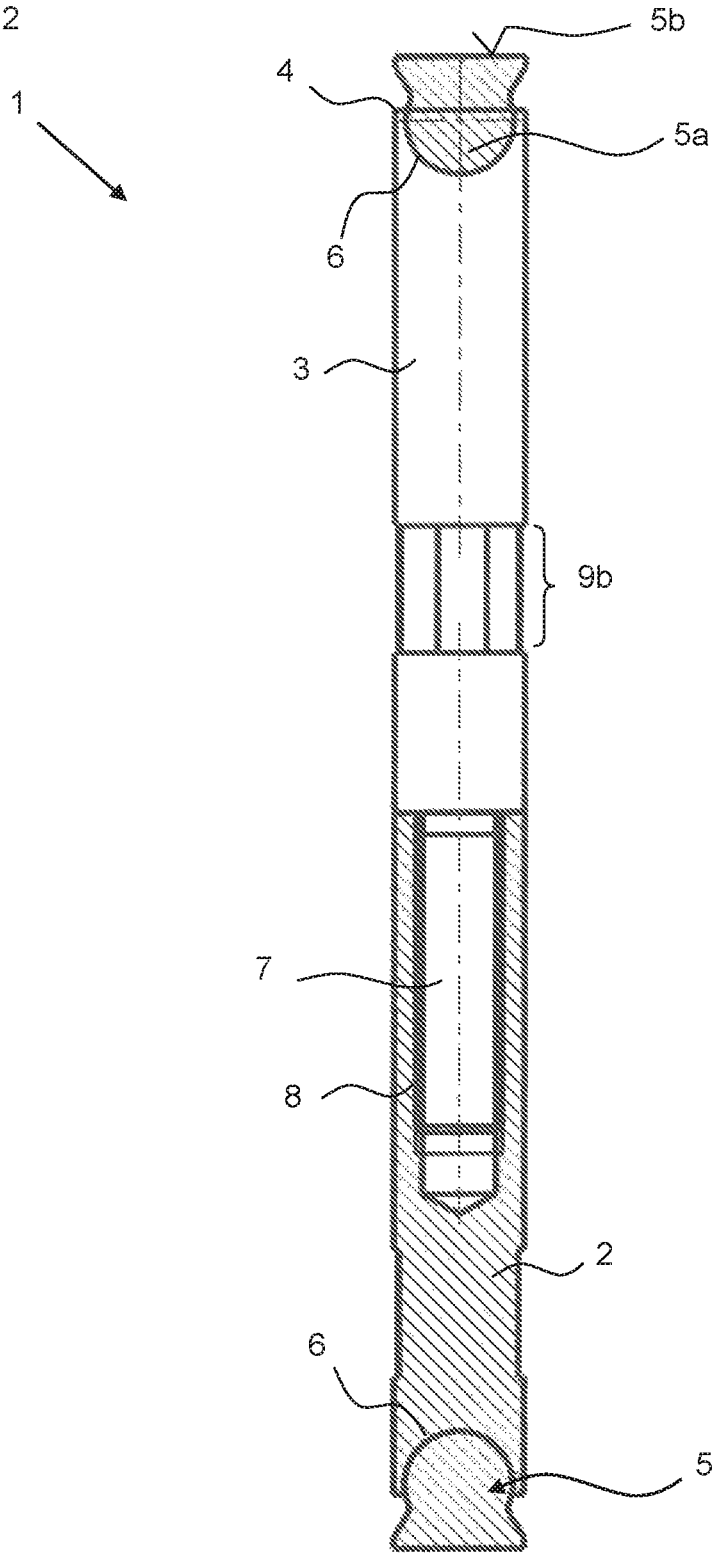
FIG. 2 shows a further longitudinal section of the sound post.

According to FIG. 1 and FIG. 2, the sound post 1 in a lower region of the figure comprises a first sound post component 2 with a first fastening portion 9*a*. Moreover, the sound post 1 has a second sound post component 3 with a second fastening portion 9*b*. The fastening portions 9*a*, 9*b* are octagonal in cross section in order to be easily gripped by a tool and also in order to be able to be moved and/or rotated relative to one another by a few degrees.

The second sound post component 3 has a threaded portion 7 which engages in a corresponding inner thread 8 of the first sound post component 2. The two threads (outer thread of the threaded post 7 and inner thread 8) are configured as a fine thread.

The fine thread present on the threaded portion 7 is cut such that a graduation of the scale 10 corresponds to the pitch of the fine thread. A graduation mark 10*a* is arranged below the scale 10 on the first sound post component 2. In this case, the scale 10 is coupled to the second sound post component 3 such that when rotating the second sound post component 3 relative to the first sound post component 2 the scale 10 moves therewith and the graduation mark 10*a* remains in situ.

A rotation of a sound post component relative to the other by one graduation mark results in a rotation of the fine thread and thus a lengthening or shortening of the entire sound post 1, so that by a full rotation of the one component relative to the other, a lengthening or shortening of the sound post by one graduation mark is achieved. The scale is intended to permit increments of 0.022 mm, such that a rotation by one graduation mark effects a lengthening or shortening of the sound post 1 by this amount.

In each case a semi-spherical recess 6 is provided in both front faces 4 of the sound post components 2, 3 and thus of the sound post 1, said recess in each case being able to receive an end piece 5. The end piece 5 has a semi-spherical portion 5*a*, wherein the dimensions thereof correspond to the dimensions of the recess 6, such that when the end piece is inserted in the recess 6 with the semi-spherical portion 5*a* the end piece 5 is tiltably mounted therein. Extending upwardly and/or downwardly in the figure, the respective end piece 5 terminates with a planar terminal surface 5*b* which when fitted in a stringed instrument is intended to bear against an inner surface of a top or a back. By means of the tiltable mounting, the end piece 5 may be adapted to the curve of the aforementioned inner surface and also to the curvature of the top and back due to atmospheric conditions.

A first magnetic element may be provided in the recess 6 on the base thereof, said first magnetic element being able to form with a second magnetic element, which is poled opposite the first magnetic element on a corresponding surface of the end piece, a magnetic fastening device (not shown in the drawings). Also, an edge of the recess 6 may be crimped in order to retain the end piece 5 in the recess 6 and to guide the tiltable mounting.

All components of the sound post 1 may be produced from carbon or a material similar thereto having a high degree of strength and stiffness.

Figure 3:
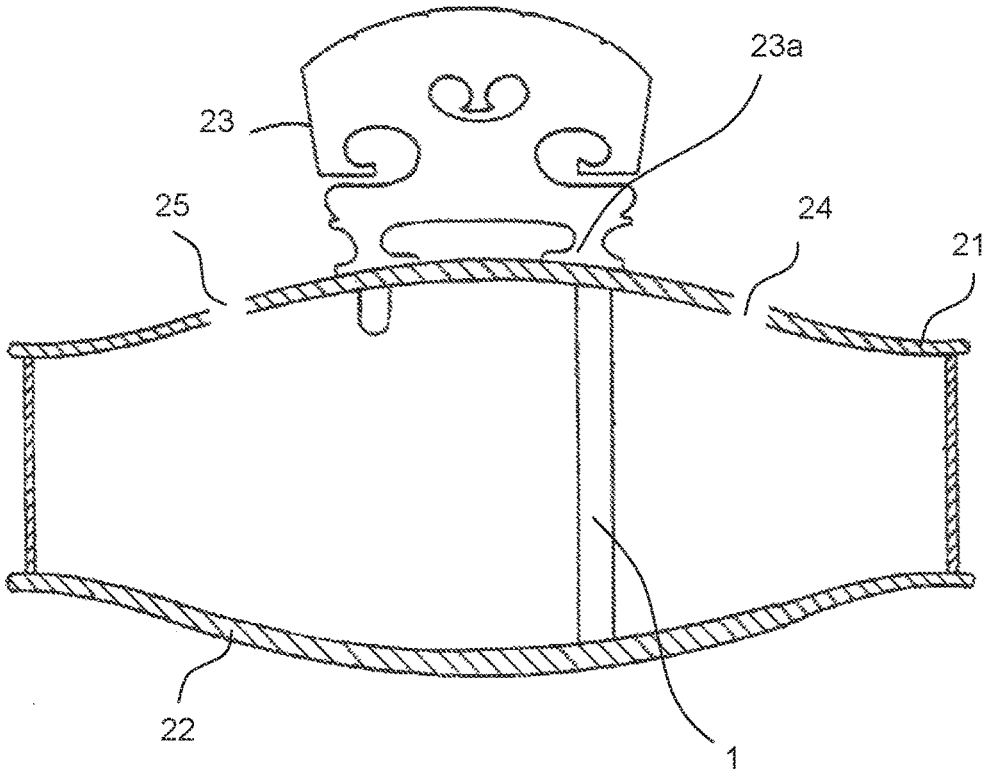
FIG. 3 shows a cross-section through a violin in the region of a predetermined position of the sound post.

FIG. 3 shows a cross-section through a violin, the sound post 1 being inserted therein, wherein the sound post 1 is clamped between the top 21 and the back 22. The sound post 1 is positioned between the top 21 and the back 22 below a right-hand foot 23*a* of a bridge 23. In each case openings are configured to the left and right of the bridge 23, i.e. a first right-hand f-hole 24 and a second left-hand f-hole 25.

The various parts of a sound post tool set are shown in the following FIGS. 4 and 5, the sound post 1 being able to be fitted thereby into a stringed instrument.

Figure 4:
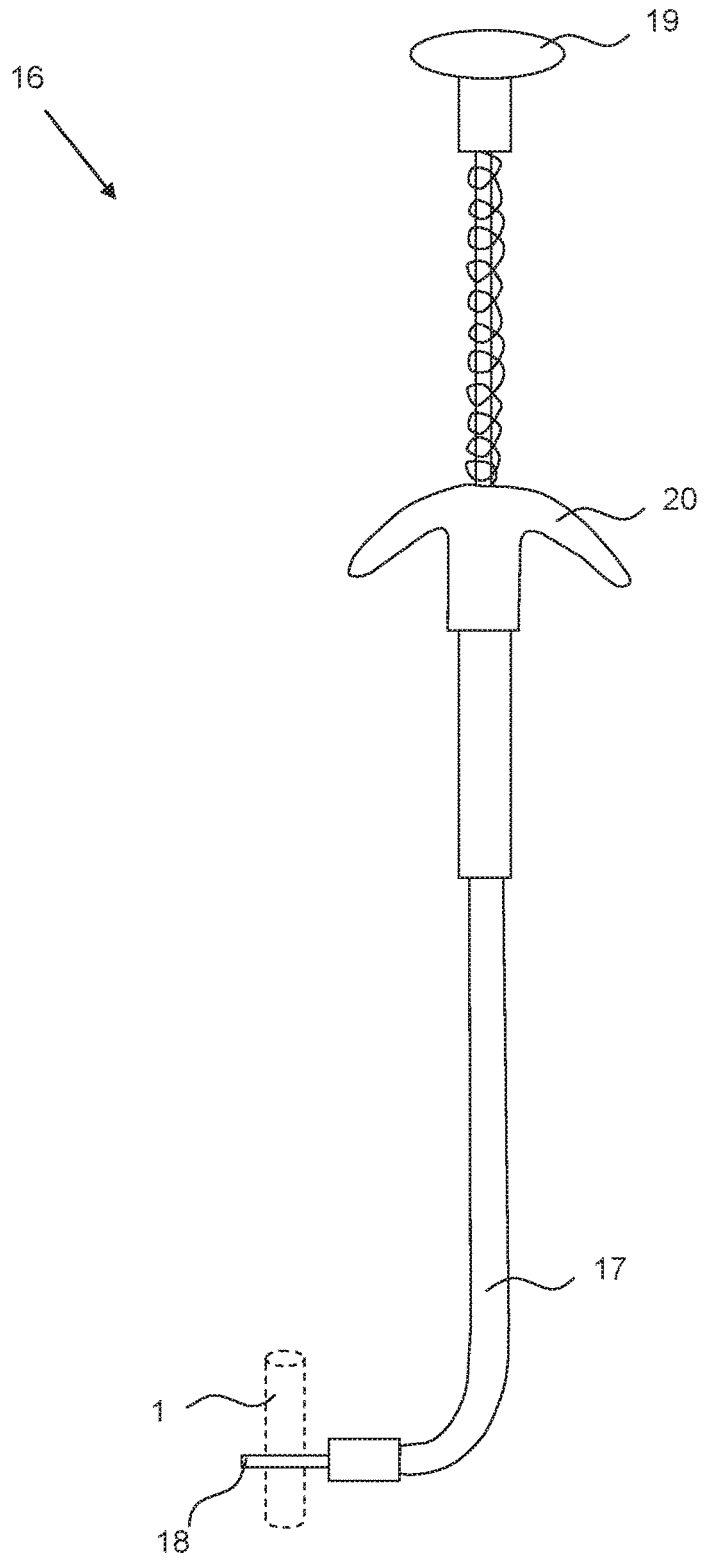
FIG. 4 shows a sectional view of an insertion tool of the sound post tool set and FIG. 5 shows a view of adjustment tools of the sound post tool set.

FIG. 4 shows an insertion tool 16 belonging to the tool set, said insertion tool having an angled-back shank 17 and a gripping region with a gripper portion 18. An actuating device in the form of a spring-loaded plunger 19 and a handle 20 are arranged on an end of the insertion tool 16 remote from the gripper portion 18.

Figure 5:
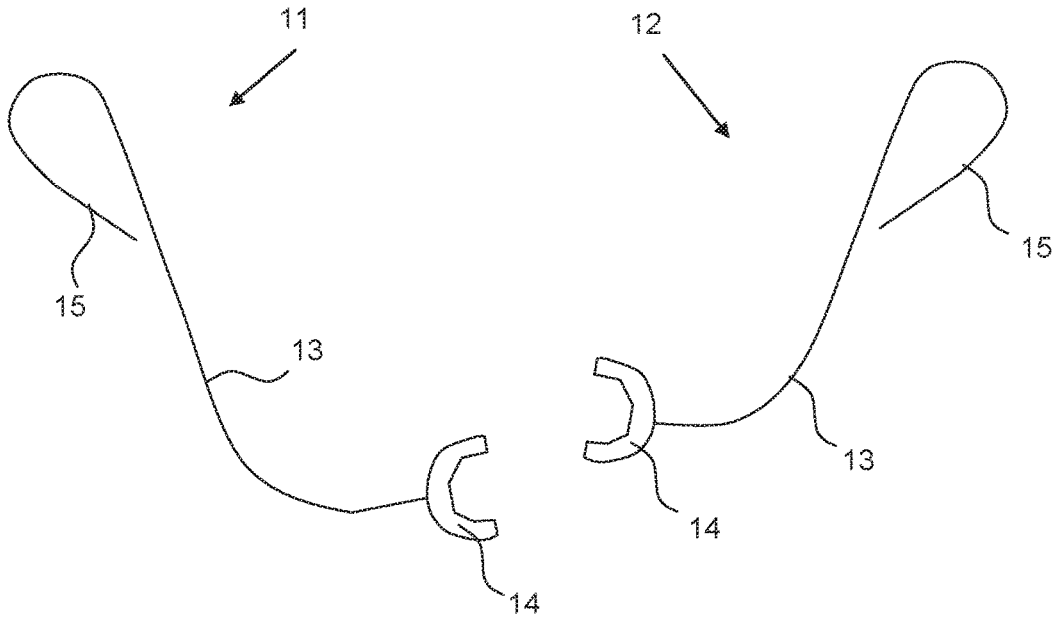

In FIG. 5 are shown further parts of the tool set according to the invention which, amongst other things, comprises two adjustment tools 11, 12. Both adjustment tools 11, 12 are substantially of the same construction: each adjustment tool 11, 12 has at a working end a tool fork 14, the size thereof being adapted to the respective sound post to be inserted. Moreover, the size of the tool fork 14 is dimensioned such that it corresponds to the dimensions of the fastening portions 9*a*, 9*b*. The adjustment tools 11, 12 also have a retaining loop 15 on the end opposing the fork 14, whereby a violin maker is able to grasp the adjustment tools 11, 12. The retaining loop 15 is connected to the tool fork 14 via a curved shank 13. In this case the curved shank 13 of the first tool 11 is configured to be longer than the shank 13 of the second tool 12. Thus for inserting and/or securing the position of the sound post 1 inside the instrument the violin maker is able to use the first adjustment tool 11, and for rotating and adjusting the height the violin maker is able to use the second adjustment tool 12. As the sound post 1 has to be arranged at a predetermined point inside the instrument, as FIG. 3 shows, which is located closer to the first f-hole 24 than to the second f-hole 25, this difference may be compensated by the different length of the tools and the sound post 1 may be easily reached and adjusted with both adjustment tools 11, 12. Retrospective adjustments may also be undertaken thereby.

LIST OF REFERENCE NUMERALS

Sound post

First sound post component

Second sound post component
Front face
End piece
5*a* Semi-spherical portion
5*b* Planar terminal surface
Recess
Threaded portion
Inner thread
9*a* First fastening portion
9*b* Second fastening portion
Scale
10*a* Graduation mark
First adjustment tool
Second adjustment tool
Shank
Fork portion
Retaining loop
Insertion tool
Angled-back shank
Gripper portion
Plunger
Handle
Top
Base
Bridge
23*a* Right-hand foot
First f-hole
Second f-hole

The invention claimed is:

1. A sound post, comprising:

at least two sound post components, including a first sound post component and a second sound post component, and pivotable end pieces disposed at respective front faces thereof;

said second sound post component having a threaded portion formed with a fine thread and said first sound post component having an inner thread configured to mesh with said threaded portion, enabling said sound post components to be screwed together and to be height-adjusted relative to one another; and a scale with an equidistant graduation disposed on one of said at least two sound post components, said graduation of said scale corresponding to a pitch of said fine thread.

2. The sound post according to claim 1, configured for a stringed instrument.

3. The sound post according to claim 1, wherein said sound post components consist of fiber-reinforced plastics.

4. The sound post according to claim 3, wherein said sound post components consist of carbon fiber-reinforced plastics.

5. The sound post according to claim 1, wherein said sound post components are substantially cylindrical and further comprising at least two fastening portions which have a polygonal cross section.

6. The sound post according to claim 5, wherein said fastening portions are octagonal in cross section.

7. The sound post according to claim 1, wherein each end piece has a hemispherical portion and a planar terminal surface and each front face of the sound post is formed with a hemispherical recess for receiving the hemispherical portion therein.

8. The sound post according to claim 7, wherein said recess for fastening said end piece is formed with a crimped portion or magnetic fastening means on an edge thereof.

9. The sound post tool set for assembling a sound post according to claim 1 between the top and back of a stringed instrument, the tool set comprising:

the sound post according to claim 1;

at least one adjustment tool including a fork portion, a shank and a retaining portion, wherein said shank is curved and has a length at least equal to a spacing distance between a predetermined stringed instrument f-hole and predetermined position for the sound post on the back of the stringed instrument.

10. The set according to claim 9, which comprises an insertion tool for inserting the sound post into the stringed instrument, wherein the insertion tool has an angled-back shank and a gripper portion.

11. The set according to claim 9, wherein said shank of said adjustment tool and the angled-back shank of said insertion tool are encased with plastics material.

12. The set according to claim 9, wherein said at least one adjustment tool is one of two adjustment tools including a first adjustment tool having a relatively longer shank and a second adjustment tool having a relative shorter shank.

13. A method for assembling a sound post according to claim 1 of a stringed instrument, the stringed instrument having a top, a back, a first f-hole, and a second f-hole, the method comprising:

providing a sound post tool set according to claim 9;

preparing and pre-adjusting the sound post to a predetermined height which is predetermined by a spacing distance between a top and back of the stringed instrument;

inserting the sound post with the insertion tool through the first f-hole of the stringed instrument and positioning the sound post at a predetermined position inside the stringed instrument;

inserting the fork portion of the first adjustment tool into the second f-hole and securing the first fastening portion with the first adjustment tool on the first fastening portion;

inserting the fork portion of the second adjustment tool into the first f-hole and encompassing the second fastening portion by way of the second adjustment tool, at the same time rotating the second sound post component in a stepwise manner and thus pressing or releasing the planar terminal surface of the end pieces onto or from the top and back of the stringed instrument.

* * * * *